US008439644B2

(12) United States Patent
O'Hearn et al.

(10) Patent No.: US 8,439,644 B2
(45) Date of Patent: May 14, 2013

(54) AIRFOIL LEADING EDGE SHAPE TAILORING TO REDUCE HEAT LOAD

(75) Inventors: Jason L. O'Hearn, Wethersfield, CT (US); Andrew S. Aggarwala, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 1451 days.

(21) Appl. No.: 11/953,290

(22) Filed: Dec. 10, 2007

(65) Prior Publication Data

US 2009/0148299 A1 Jun. 11, 2009

(51) Int. Cl.
*F01D 5/14* (2006.01)

(52) U.S. Cl.
USPC ..... 416/223 A

(58) Field of Classification Search ..... 416/223 A, 416/DIG. 2, DIG. 3, 224
See application file for complete search history.

(56) References Cited

U.S. PATENT DOCUMENTS

| | | | | |
|---|---|---|---|---|
| 2,788,569 | A * | 4/1957 | Stalker | 29/889.72 |
| 2,960,305 | A * | 11/1960 | Stalker | 416/232 |
| 5,035,578 | A | 7/1991 | Tran | |
| 5,117,626 | A | 6/1992 | North et al. | |
| 5,337,568 | A | 8/1994 | Lee et al. | |
| 5,351,917 | A | 10/1994 | Bulman | |
| 5,383,766 | A | 1/1995 | Przirembel et al. | |
| 5,711,650 | A | 1/1998 | Tibbott et al. | |
| 5,779,437 | A | 7/1998 | Abdel-Messeh et al. | |
| 6,050,777 | A | 4/2000 | Tabbita et al. | |
| 6,099,251 | A | 8/2000 | LaFleur | |
| 6,139,258 | A * | 10/2000 | Lang et al. | 415/116 |
| 6,164,912 | A | 12/2000 | Tabbita et al. | |
| 6,183,197 | B1 | 2/2001 | Bunker et al. | |
| 6,210,112 | B1 | 4/2001 | Tabbita et al. | |
| 6,375,126 | B1 | 4/2002 | Sakurai et al. | |
| 6,595,748 | B2 | 7/2003 | Flodman et al. | |
| 6,609,894 | B2 * | 8/2003 | Jackson et al. | 416/224 |
| 6,629,817 | B2 * | 10/2003 | Shelton et al. | 415/115 |
| 6,669,447 | B2 * | 12/2003 | Norris et al. | 416/224 |
| 6,994,521 | B2 | 2/2006 | Liang | |
| 7,018,176 | B2 | 3/2006 | Mongillo et al. | |

FOREIGN PATENT DOCUMENTS

| | | | |
|---|---|---|---|
| EP | 0924384 | A2 | 6/1999 |
| EP | 1013877 | A2 | 6/2000 |
| EP | 1262631 | A2 | 12/2002 |

OTHER PUBLICATIONS

W.F.N. Santos. "Leading-edge Bluntness Effects on Aerodynamic Heating and Drag of Power Law body in Low-Density Hypersonic Flow." Journal of the Brazilian Society of Mechanical Sciences and Engineering, vol. XXV11, No. 3, Jul. 2005, Sep. 2005, pafes 236-242, XP002670941, Rio de Janeiro.*

(Continued)

*Primary Examiner* — Richard Edgar
(74) *Attorney, Agent, or Firm* — Carlson, Gaskey & Olds, P.C.

(57) ABSTRACT

An airfoil includes a leading edge surface that includes a non-continuous curvature distribution. A stagnation region of the airfoil includes a curvature larger than adjacent segments to reduce heat transfer into the airfoil. The reduced curvature in the stagnation region is surrounded by the adjacent segments with larger curvatures to tailor the airfoil surface to provide a desired balance between heat transfer properties and aerodynamic performance.

12 Claims, 2 Drawing Sheets

OTHER PUBLICATIONS

W.F.N. Santos: "Leading-edge Bluntness Effects on Aerodynamic Heating and Drag of Power Law Body in Low-Density Hypersonic Flow", Journal of the Brazilian Society of Mechanical Sciences and Engineering, vol. XXVII, No. 3, Jul. 2005, Sep. 2005, pp. 236-242, XP002670941, Rio de Janeiro.

Extended European Search Report dated Mar. 26, 2012 for EP Application No. 08253201.1.

* cited by examiner

AIRFOIL LEADING EDGE SHAPE TAILORING TO REDUCE HEAT LOAD

This invention was made with government support under Contract No.: N00019-02-C-3003 awarded by the Air Force, Navy and Marines. The government therefore may have certain rights in this invention

BACKGROUND OF THE INVENTION

This invention generally relates to an airfoil such as is utilized in an axial flow turbine. More particularly, this invention relates to a particular airfoil profile that reduces the stagnation heat transfer coefficient on the airfoil's surface.

Turbine airfoils utilized in axial flow turbines can operate at extreme temperatures. These elevated temperatures can lead to undesired oxidation and degradation of both the airfoil and platforms. For this reason, a cooling system is typically integrated into the airfoil to reduce the transfer of heat to the turbine airfoil. Known cooling systems focus on reducing heat transfer to all surfaces of the turbine airfoil to provide an overall reduction in airfoil metal temperature.

The region of largest heat transfer coefficient is located about the airfoil's stagnation point located on the leading edge of the airfoil. High temperature core gas encountering the leading edge of an airfoil will diverge around a suction and pressure side of the airfoil. Some of the high temperature core gas will impinge on the leading edge. The point on the airfoil where the velocity of the flowing gas approaches zero is the stagnation point. There is a stagnation point at every spanwise position along the leading edge collectively referred to as the stagnation line.

The heat transfer coefficient near the stagnation point of the airfoil is proportional to the local curvature of the airfoil surface. Therefore, the smaller the curvature or larger the radius of the airfoil section's surface, the smaller the heat transfer coefficient, and the lower the temperature along the airfoil. However, increasing the leading edge radius thereby reducing the local curvature about the stagnation point can undesirably affect aerodynamic performance.

Accordingly, it is desirable to develop and design an airfoil that reduces the surface temperatures of the airfoil at the leading edge while minimizing impact to aerodynamic performance.

SUMMARY OF THE INVENTION

An example airfoil includes a leading edge surface that features a non-continuous curvature distribution tailored to minimize heat transfer in a stagnation region of the airfoil.

The example airfoil includes a continuous surface with separate segments having different curvatures. A first segment includes the stagnation region and includes a first curvature that is less then a second and third curvature disposed within corresponding second and third segments disposed on either side of the first segment. The lower curvature of the first segment reduces the rate of heat transfer to the airfoil in the stagnation region without undesirably altering the aerodynamic performance of the airfoil.

The airfoil includes a fourth and fifth segment outboard of corresponding second and third segments. The forth and fifth segments include corresponding forth and fifth curvatures that are both less than the curvatures of the corresponding adjacent second and third segments.

Accordingly, the continuous surface includes a curvature that decreases at the stagnation region to reduce heat transfer into the airfoil.

These and other features of the present invention can be best understood from the following specification and drawings, the following of which is a brief description.

DETAILED DESCRIPTION OF THE PREFERRED EMBODIMENT

Figure 1:
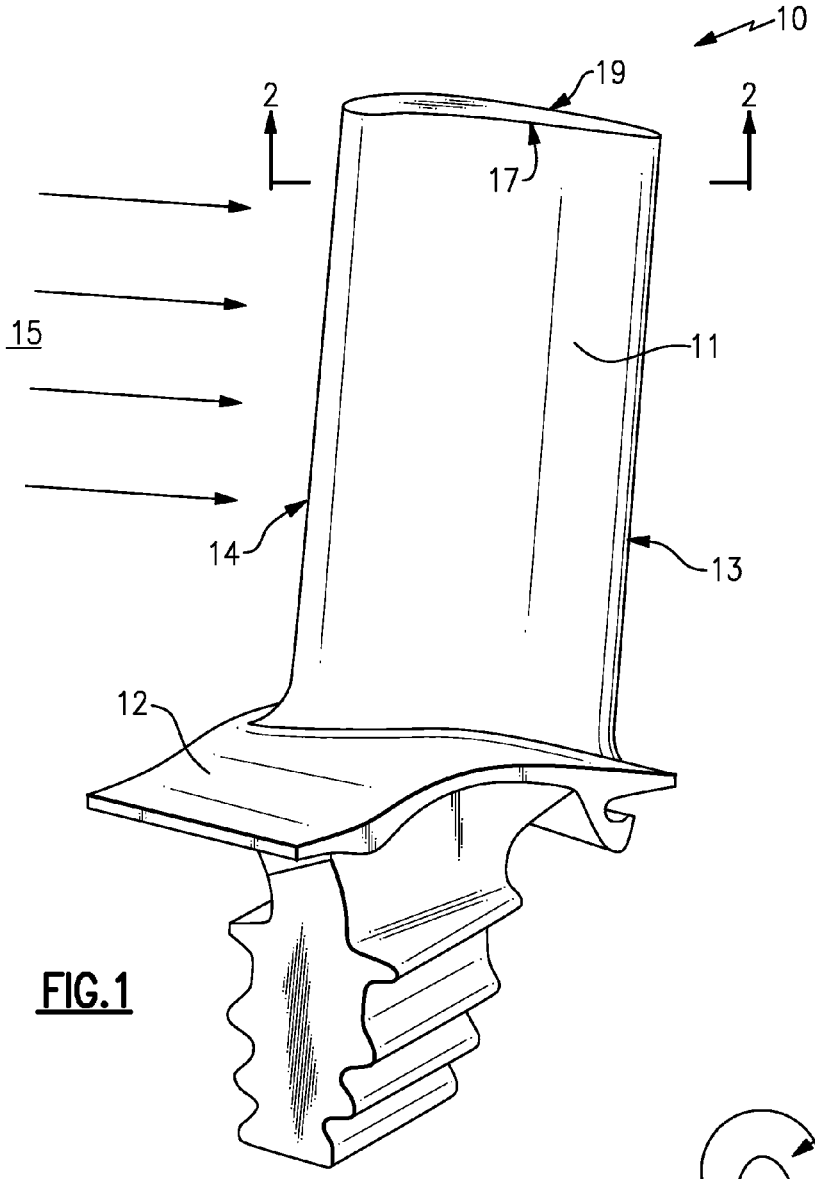
FIG. 1 is a perspective view of an example turbine blade assembly.
Figure 2:
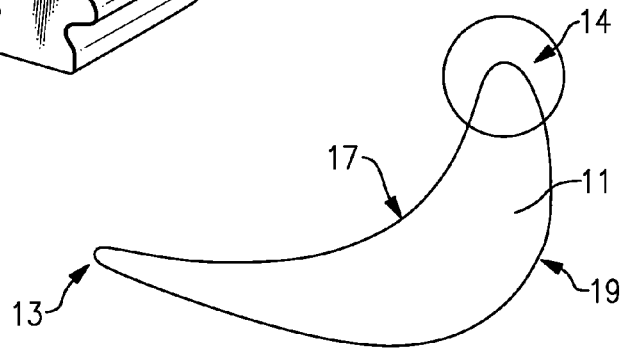
FIG. 2 is a cross-sectional view of the example turbine blade assembly.

Referring to FIGS. 1 and 2, an example turbine blade assembly 10 includes an airfoil 11 extending upward from a platform 12. The airfoil 11 includes a leading edge 14, a trailing edge 13, a pressure side 17 and a suction side 19. The example airfoil 11 includes a leading edge profile for reducing heat transfer from high temperature airflow 15 in a stagnation region of the airfoil 11. The example airfoil 11 is described in reference to a turbine blade assembly 10 but the invention is applicable to any airfoil assembly such as for example fixed vanes and rotating blades along with any other airfoil structures.

Figure 3:
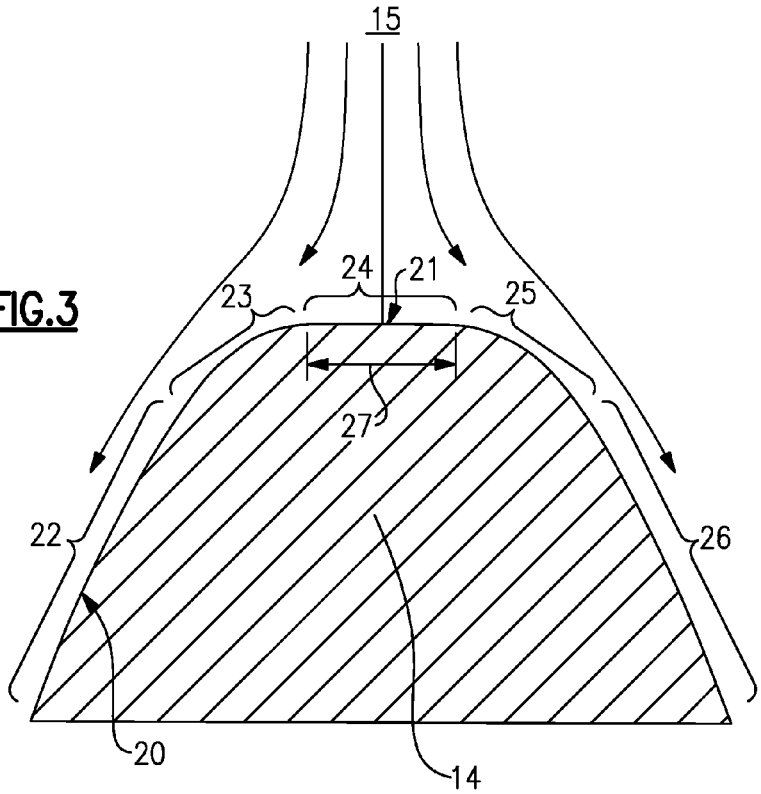
FIG. 3 is a zoomed in view of the LE region of the airfoil section in FIG. 2.

Referring to FIG. 3, the example leading edge 14 is shown in cross-section and includes a continuous surface 20 that is divided into five distinct segments. A first segment 24, a second segment 23, a third segment 25, a fourth segment 22 and a fifth segment 26. Airflow, indicated as 15, moving around the surface 20 transfers heat to the leading edge 14. The greatest heat transfer coefficient coincides with a stagnation region 21. The stagnation region 21 is the region on the leading edge surface 20 where the flow 15 splits into two streams, one that flows over portions 22 and 23 while the other flows over portions 25 and 26. The velocity of air flow 15 in the stagnation region is substantially zero.

The amount of heat transfer from the airflow 15 into the leading edge 14 is determined in part by the shape and profile of the surface 20. In the stagnation region 21, heat transfer between the airflow 15 and the leading edge 14 can be reduced with a lower surface curvature. The curvature relates to the cross-sectional radius of a segment of the surface 20. The lower the curvature, the greater the radius. The curvature of the airfoil surface 20 in the stagnation region is related to the radius according to the relationship:

$$k \propto \frac{1}{r}$$

where k is the curvature of a surface; and r is a radius of curvature of the surface.

The region of the leading edge surface 20 near the stagnation region includes very small changes in radius of curvature so the above relationship represents the curvature being proportional to the inverse of the radius of the surface 20. In other words, as the radius decreases over a portion of the surface 20 the curvature increases.

Reducing the overall curvature of the surface 20, and thereby increasing the radius can have an undesirable impact on aerodynamic performance of the airfoil 11. Accordingly, reducing the leading edge curvature by increasing the leading edge radius and in turn making the entire airfoil 11 cross-section larger is not always desirable.

Heat transfer from the airflow 15 into the leading edge 14 can be closely estimated by assuming that airflow about the leading edge 14 behaves much like airflow around a cylinder having a diameter d. Heat transfer of a cylinder in cross flow is a function of both the diameter of the cylinder and the reference angle θ in the stagnation region. Accordingly, heat transfer into the leading edge 14 can be accurately estimated by a simplified relationship for a cylinder in air flow according to the relationship:

$$h_{Cyl} \propto \frac{\theta^3}{d} \propto k\theta^3$$

Where $h_{Cyl}$ is the heat transfer coefficient near the leading edge 14;

θ is a reference angle that is equal to 0 at the stagnation point 21;

d is the diameter of a cylinder.

Because of the relationship between curvature and heat transfer illustrated by the above relationship, an increase in curvature in regions adjacent to stagnation region 21 reduces heat transfer in the stagnation region 21 because the reference angle θ cubed is either decreasing faster than or equal to the rate that curvature is increasing along the surface 20.

The fourth segment 22 includes a fourth curvature. The fifth segment 26 includes a fifth curvature. The fourth and fifth segments 22, 26 are farthest from the stagnation region 21. The fourth curvature and the fifth curvature are similar to that of a conventional airfoil leading edge surface. The second segment 23 and the third segment 25 are located on either side of the first segment 24 and include a curvature that is greater than the fourth and fifth curvatures. Further, the curvatures of the second segment 23 and the third segment 25 are greater than the curvature of the first segment 24. The first segment 24 includes a reduced curvature relative to the adjacent second and third segments 23, 25.

The increased curvature of the first segment 24 is disposed over a width 27 to accommodate the stagnation region 21 and any movement of the stagnation region caused by changes in operational parameters.

The reduced curvature of the first segment tailors the surface 20 to the stagnation region 21 to reduce heat transfer to the airfoil 11. First and second segments 23 and 25 contain curvatures that are greater than the curvatures of the fourth and fifth segments 22 and 26 to provide for the creation of the lower curvature within the first segment 24 and the stagnation regions 21.

The resulting profile of continuous non-interrupted surface 20 includes a non-continuous curvature distribution that provides a relatively lower curvature within the stagnation region 21. The non-continuous curvature distribution tailors local curvature across the surface 20 to provide the desired localized heat transfer properties without substantially affecting desired aerodynamic performance.

Figure 4:
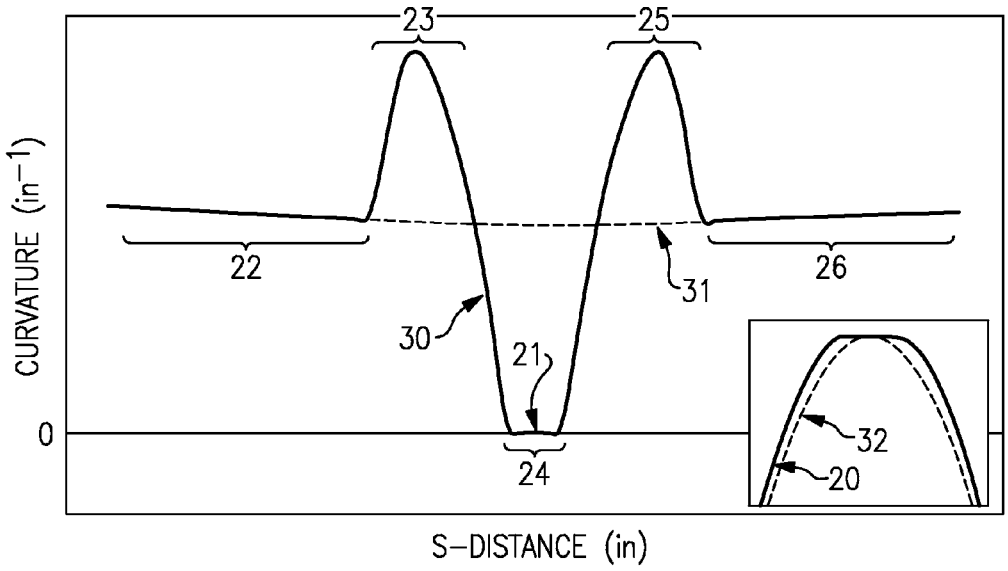
FIG. 4 is a plot illustrating an example curvature distribution around the leading edge of the example airfoil.

Referring to FIG. 4, a plot illustrates the relationship of the surface curvature around the leading edge surface 20 of the example airfoil 11. The line 30 represents the curvature of the leading edge surface 20 of the example airfoil 11. The dashed line 31 represents the curvature of a comparable prior art airfoil leading edge surface 32. The curvature of the second and third segments 23 and 25 is greater than those of a prior art airfoil. The increased curvature of the second and third segments 23 and 25 provides for the lower curvature of the first segment 24. The lower curvature of the first segment 24 provides for the reduction in the stagnation region 21 heat transfer coefficient. The heat transfer coefficients of the second and third segments 23 and 25 are increased due to the increase in local curvature. The balance of small increases in heat transfer to surfaces within the second and third segments 23 and 25 with the decrease in heat transfer within the first segment 24 and the stagnation region 21 provides an overall improvement and reduction of heat transfer across the entire airfoil surface 20. The local tailoring of the airfoil surface 20 provides a curvature within the stagnation region 21 that is comparable to a much larger airfoil with a conventional shape.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An airfoil assembly comprising:

a first segment including a stagnation region of the airfoil having a first curvature substantially equal to zero within the stagnation region;

a second segment having a second curvature on a first side of the first segment; and a third segment having a third curvature on a second side of the first segment, wherein the first curvature is less than the second curvature and the third curvature, wherein the second and third curvatures are symmetric about the stagnation region and the airfoil comprises a hollow structure and the first segment, the second segment and the third segment comprise a continuous uninterrupted surface.

2. The assembly as recited in claim 1, including a fourth segment including a fourth curvature disposed on a side of the second segment opposite the first segment and a fifth segment including a fifth curvature disposed on a side of the third segment opposite the first segment, the fourth curvature being less than the second curvature and the fifth curvature being less than the third curvature.

3. The assembly as recited in claim 1, wherein the first segment, the second segment, the third segment, the fourth segment, and the fifth segment comprise a continuous uninterrupted surface.

4. The assembly as recited in claim 1, wherein the first segment, the second segment and the third segment define the leading edge of the airfoil assembly.

5. The assembly as recited in claim 4, wherein the stagnation region of the airfoil extends spanwise a length of the airfoil along the leading edge.

6. The assembly as recited in claim 1, wherein the first segment, the second segment, and the third segment are disposed within a common plane.

7. A blade assembly comprising:

a platform; and an airfoil including a first segment including a leading edge with a first curvature substantially equal to zero at the leading edge, a second segment on a suction side of the first segment having a second curvature and a third segment on a pressure side of the first segment having a third curvature, wherein the first curvature is less than the second curvature, the third curvature and the first and second curvatures are symmetrical about the leading edge, and the first segment, the second segment and the third segment comprise a continuous uninterrupted surface.

8. The assembly as recited in claim 7, including a fourth segment having a fourth curvature disposed outside of the second segment and a fifth segment having a fifth curvature disposed outside of the third segment, wherein the fourth curvature and the fifth curvature are both less than the second curvature and the third curvature.

9. The assembly as recited in claim 7, wherein the leading edge includes a stagnation region.

10. The assembly as recited in claim 9, wherein the stagnation region extends lengthwise along the entire airfoil.

11. The assembly as recited in claim 7, wherein the continuous uninterrupted surface includes the fourth segment and the fifth segment.

12. The assembly as recited in claim 7, wherein the airfoil comprises a stator vane, and the platform comprises an inner platform and an outer platform and the airfoil extends between the inner platform and the outer platform.

* * * * *